US006149200A

United States Patent [19]

Lockhart

[11] Patent Number: 6,149,200

[45] Date of Patent: Nov. 21, 2000

[54] REPORT COVER AND METHOD OF MAKING

[76] Inventor: William E. Lockhart, 8335 Coral Dr., Dallas, Tex. 75243

[21] Appl. No.: 09/465,657

[22] Filed: Dec. 17, 1999

[51] Int. Cl.[7] ..... B24D 3/00

[52] U.S. Cl. ..... 281/29; 281/33; 281/31; 281/37; 281/21.1; 402/6

[58] Field of Search ..... 281/29, 31, 33, 281/35, 36, 37, 21.1, 15.1; 402/70, 73; 412/1, 4, 6

[56] References Cited

U.S. PATENT DOCUMENTS

| | | | |
|---|---|---|---|
| 1,439,138 | 12/1922 | White | 281/1 |
| 1,614,977 | 1/1927 | Ausmus | 281/33 |
| 3,111,126 | 11/1963 | Brinkmann et al. | 402/14 |
| 4,240,761 | 12/1980 | Jacobson | 281/33 |
| 4,548,426 | 10/1985 | Lockhart | 281/1 |
| 4,706,994 | 11/1987 | Lockhart | 281/29 |
| 5,236,226 | 8/1993 | Sheffield | 281/31 X |
| 5,351,992 | 10/1994 | Chilson et al. | 281/31 |
| 5,407,230 | 4/1995 | Brink et al. | 281/31 X |

FOREIGN PATENT DOCUMENTS

| | | | |
|---|---|---|---|
| 127964 | 4/1932 | Australia | 281/29 |
| 456901 | 4/1950 | Italy | 281/29 |
| 842594 | 7/1960 | United Kingdom | 282/22 R |

*Primary Examiner*—Willmon Fridie, Jr.
*Attorney, Agent, or Firm*—Thompson & Gustavson L.L.P.

[57] ABSTRACT

A report cover (100) is disclosed for securing and protecting a report (12). The report cover (10) includes a front panel (102) and a rear panel (104). Three parallel hinges (22, 24, 26) are formed in the front panel (14). A single hinge (36) is formed in the rear panel (16). The report is secured between the front and rear panels near the first edges (20, 34) of the panels as by staples or other removable fasteners. The front panel (14) is then folded about the hinges to lie parallel to and adjacent the rear panel. The rear panel is captured within a pocket portion (106) which permits limited motion of the rear panel (104) relative to the pocket portion (106). To disassemble the report cover and remove the report therefrom, the pocket portion (106) need only be disengaged from the rear panel (104) providing easy access to the fasteners for removal of the fasteners and removal of the report from the report cover.

3 Claims, 7 Drawing Sheets

100
112
110
116
106
132
102
114
a
b
c
120
118
20
132
26
24
22
52
126
d
12
108
34
36
108
104
128
108

REPORT COVER AND METHOD OF MAKING

BACKGROUND ART

Documents, such as audit and business reports, tax returns and proposals, are often secured within a report cover. The cover can be used to protect the documents and reduce the likelihood of damage thereto. The cover is often employed to impress the recipient and to increase the perceived value of services rendered. Ideally, the report cover should secure the report therein yet permit ease of access to the report. In particular, if the report is opened to a certain page while lying on a desk, the report cover should not cause pages of the report to flyback or have a tendency to close the report. It is also desirable to cover any staples or other fastening members to provide a more pleasing and professional appearance to the report. Ideally, the report cover should be reusable indefinitely and should permit the rapid insertion or deletion of the document therein to update the document.

Several attempts have been made to construct report covers having the above-noted features. One example is the QUICK BIND system sold by Gestetner Corporation of Gestetner Park, Yonkers, N.Y. 10703. This system requires the punching of numerous small holes along one edge of each page in the document to accommodate costly binding members. A bar, having thin rod-like members extending from one side of the bar, is positioned on one side of the document, with the rod-like pins extending through the holes formed in the document. A second bar, having apertures for receiving the ends of each. pin, is positioned on the opposite side of the document. The pins pass through the apertures in the second bar and are thermally bound thereto to secure the document. This system has several drawbacks. It is virtually impossible to open a document bound by this system and place it on a table without flyback of pages of the report or the report closing. Severe bending of the pages of the report or a paperweight may be necessary to keep the report open to the page desired. This bending can accidentally tear individual sheets from the report, because the binding holes are extremely close to the edge of the document sheet. Also, it requires a separate and costly device to punch the holes in the paper and to bind the pins to the second bar. Misalignment of the punching tool will ruin pages of the document. The bars prevent ready filing of the documents within conventional filing systems and do not have a pleasing appearance. Once bound within the system, the removal of the document would essentially require the destruction of the binding system.

A multiple ring cover is also commonly used. This requires the cutting of circular or elongate holes in the document along an edge thereof. A binding member is provided which extends along the length of the document to be bound and on which are mounted loops, each comprised of two overlapping semicircular flexible rings, which can be threaded through the holes put in the document to secure the document together. This system has many drawbacks. Every document page and both covers must be carefully jogged and inserted into a special machine that punches holes in only a few sheets of paper at a time. Pages not properly jogged or inserted into the machine will be punched too close to the edge—and ruined. After punching, every hole in every sheet must be threaded over the member's circular rings which have been spread open by a special machine. The large, protruding binding member detracts from the professional appearance of the report and causes major problems in report handling, filing and mailing. Since all document pages are loosely bound and may be easily removed-either accidentally or intentionally—this system provides virtually no security for permanent reference to valuable documents.

The above binding techniques, and other techniques, have not been totally satisfactory. Each of these techniques has had one or more disadvantages such as mentioned previously. A need therefore exists for a report cover which satisfies most or all of the advantages noted above for a low manufacturing price.

U.S. Pat. No. 4,548,426, issued Oct. 22, 1985 and U.S. Pat. No. 4,706,994, issued Nov. 17, 1987, disclose a significant improvement in binding techniques.

SUMMARY OF THE INVENTION

In accordance with one aspect of the present invention, a report cover is provided for binding a report. The binder includes a front panel having a first edge and at least three parallel hinges approximate the first edge. A back panel is also provided. Fastening structure is provided for fastening the report between the front and back panels along one edge of the report. The fastening is made between the first edge of the front panel and the closest of said parallel hinges. The front panel is folded about the parallel hinges to cover the edge of the report and bind the report. A pocket portion holds the back panel.

In accordance with another aspect of the present invention, a report cover is provided for a report which includes a front panel having a first edge and at least three parallel hinges proximate and extending parallel to the first edge. A back panel is provided having a first edge and at least one hinge proximate the first edge of the back panel and extending parallel thereto. Fastening structure is provided for fastening the report between the front and back panels along one edge of the report proximate the first edges of the front and back panels between the first edge and closest hinge of each panel. The front panel is folded at the hinges to cover the edge of the report and to extend along the back panel on the side opposite the report. A pocket portion secures the back panel, the hinges proximate the first edge on each panel cooperating to permit the report to be opened to selected pages and remain open in the absence of an external force.

In accordance with yet another aspect of the present invention, a method is provided for forming a report cover. The method includes the steps of securing the report between front and back panels forming at least three parallel hinges proximate a first edge of a front panel and along one edge of the report. The method further includes the step of folding the front panel along the three parallel hinges to cover the edge of the report and securing the front and back covers together to bind the report. The back panel is positioned in a pocket portion. In addition, the product resulting from this method is also provided.

BRIEF DESCRIPTION OF THE DRAWINGS

A more complete understanding of the invention and its advantages will be apparent from the following Detailed Description when taken in conjunction with the accompanying Drawings, in which.

DETAILED DESCRIPTION

Figure 1:
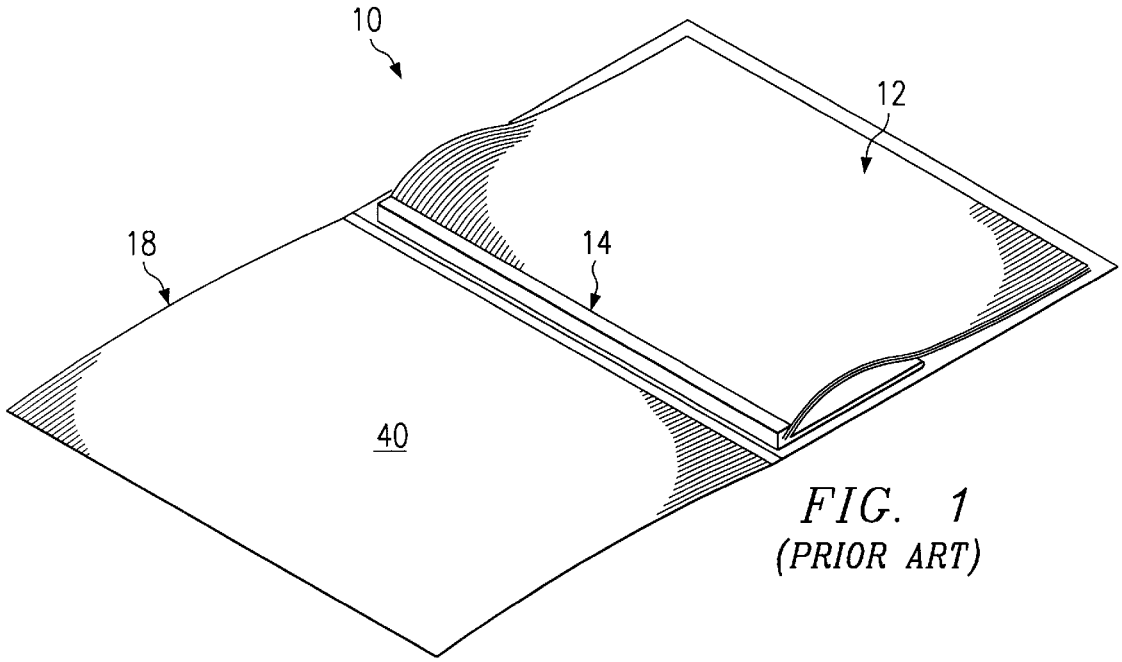
FIG. 1 (PRIOR ART)
FIG. 1 is a perspective view of a report cover forming a first embodiment of the present invention.

Referring now to the Drawings, wherein like reference characters designate like or corresponding parts throughout several views, a report cover 10 is illustrated in FIGS. 1–4. The report cover 10 is intended to secure a report 12 therein. The report cover 10 acts to bind the report 12 and also provides protection to resist damage to the pages of the report 12. It will be understood that the report 12 can include paper documents as, for example, audit reports and tax returns, and any other materials with which the report cover 10 could be employed.

The report cover 10 includes a front panel 14, a rear panel 16 and a cover 18. The report cover 10 is designed for purchase by the final user with the panels 14 and 16 and cover 18 separate so that the user can assemble the report cover and report in a manner described hereinafter.

The front panel 14 is a generally rectangular piece of material, such as paper, with a length corresponding to the length of the report. A first edge 20 forms one edge of the front panel 14. A series of parallel hinges are formed proximate the first edge, including a first hinge 22, a second hinge 24, and a third hinge 26.

Each of the hinges 22, 24, and 26 extend parallel the first edge 20. The first hinge 22 is spaced a distance a from the edge 20. The second hinge 24 is spaced a distance b from the first hinge 22. The third hinge 26 is spaced a distance c from the second hinge 24. In the preferred construction, the distance b is larger than the distances a and c. The hinges 22, 24 and 26 can be formed by various techniques. For example, if the front panel 14 is formed of a relatively heavy weight paper, the paper can be scored along the position of the hinges to form the hinges.

Adhesive strips 28 and 30 are positioned on side 32 of the front panel 14. These adhesive strips 28 and 30 also extend generally parallel to the first edge 20. Each of the adhesive strips is positioned on the side of the hinges 22, 24 and 26 opposite the first edge 20 as seen in FIG. 2.

The rear panel 16 also has a first edge 34 forming one of the edges of the panel. A first hinge 36 is provided on the rear panel 16 parallel to and spaced distance d from the first edge 34. Again, the hinge can be formed by several methods, including the scoring of the hinge if the rear panel 16 is formed of a relatively heavy weight paper. An adhesive strip 38 is provided on the rear panel 16 and extends proximate the edge of the rear panel opposite the first edge 34.

The cover 18 generally includes a front cover portion 40, an end portion 42 and a rear cover portion 44. The cover 18 can be formed with portions 40, 42 and 44 by forming parallel hinges 46 and 48 separated by a distance e. If the cover 18 is formed of paper, the hinges 46 and 48 can be formed by scoring a line in the paper to form the hinges.

Figure 3A:
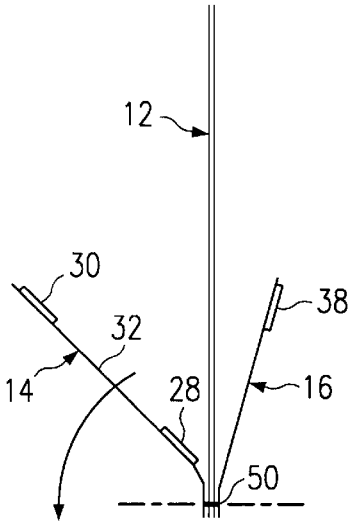
FIG. 3a (PRIOR ART)
FIGS. 3*a–c* illustrate the folding of the front panel to bind the report between the front and back panels.
Figure 2:
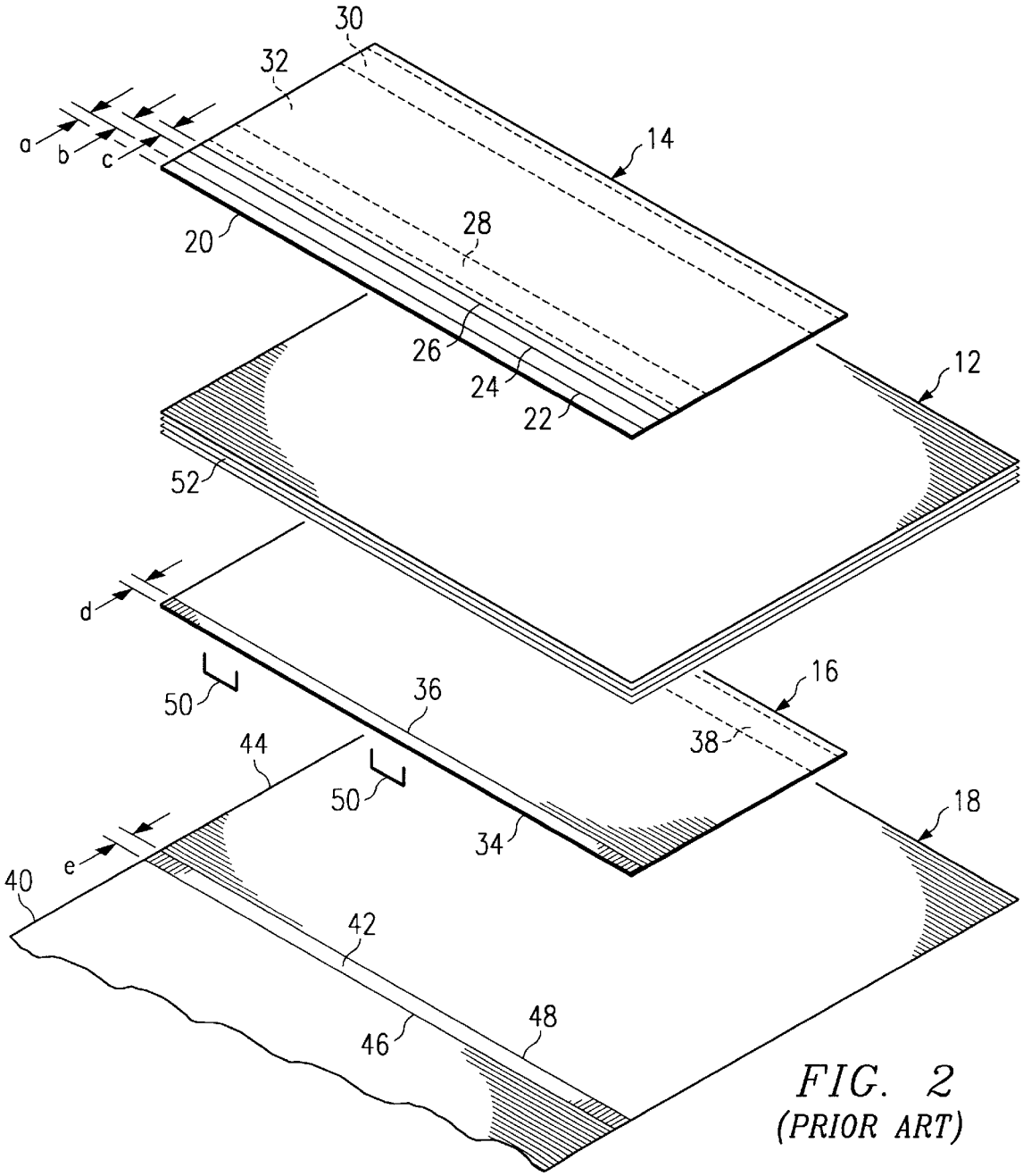
FIG. 2 (PRIOR ART)
FIG. 2 is an exploded perspective view of the report cover shown in FIG. 1.

To bind the report 12 within the report cover 10, the front panel 14, rear panel 16, cover 18 and report 12 are positioned as shown in FIG. 2. The report 12 is then fastened between the front panel 14 and rear panel 16 along edge 52 as shown in FIG. 3*a*. The report can be fastened by staples 50 or any other suitable fastening structure. The report 12 is fastened to the front panel and rear panel within portions 60 and 62 of the panels, formed between the first edge and first hinge of each of the panels.

Figure 3B:
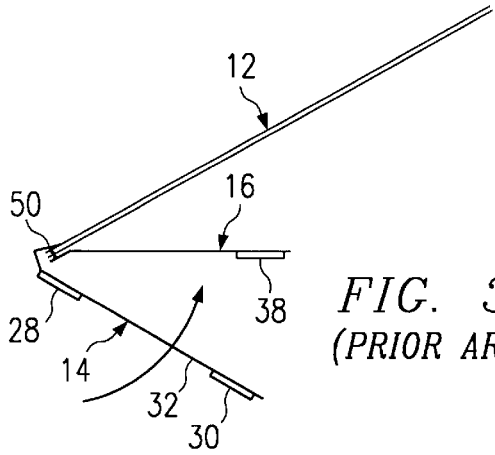
FIG. 3b (PRIOR ART)
Figure 3C:
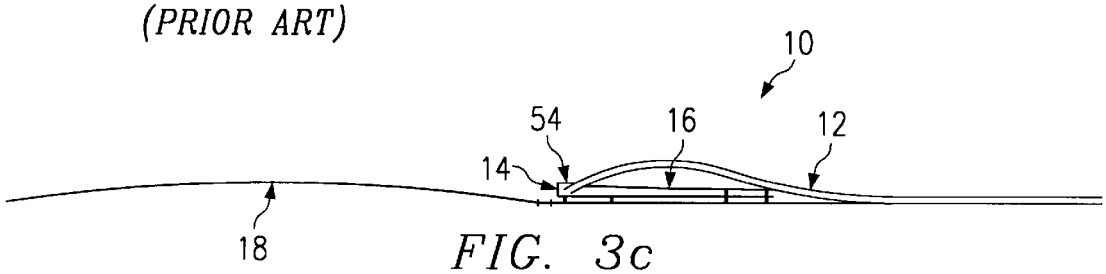
FIG. 3c (PRIOR ART)

The front panel 14 is then folded about hinges 22, 24 and 26 as illustrated in FIGS. 3*a–c*. As the front panel 14 is folded, the front panel covers the edge 52 of the report 12 fastened between the front and rear panels. As can be seen in FIG. 3*c*, the front panel 14 is folded about the hinges until the portion of the front panel 14 extending from the third hinge 26 and having the adhesive strips 28 and 30 lies parallel and abuts the rear panel 16 on the side opposite the report 12. The adhesive strip 38 is then activated to secure the front and rear panels 14 and 16 in the position illustrated in FIG. 3*c*. The strip 38 can be activated by removing a nonstick protective layer from the strip or by activation through heating, moisturizing or other methods.

The front panel 14 and rear panel 16 combine to form a panel module 54. This module 54 is then secured to the cover 18 by activating the adhesive strips 28 and 30 to fasten the front panel 14 to the inside of the rear cover portion 44 near the end portion 42 as shown in FIG. 3*c*. Again, the adhesive strips 28 and 30 can be activated in a manner similar to adhesive strip 38.

Upon completion of the above recorded steps, the assembly of the report cover 10 has been completed with the report 12 fastened therein. The report cover 10 will permit the report 12 to be opened, as on a desk top, to a certain page in the report and will not cause flyback of pages or force the report to close. No external force or severe bending of the pages of the report are needed to keep the report open to the desired page as is commonly needed in the prior art.

Figure 4A:
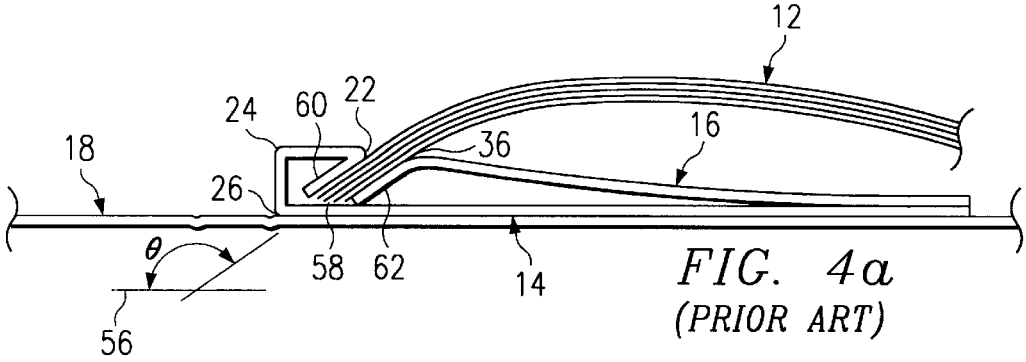
FIG. 4a (PRIOR ART)
FIGS. 4*a–c* illustrate the pivoting action of the hinges in the front and back panels which permits the report to be opened to any page without the cover exerting a force to cause flyback of pages or close the report.
Figure 4B:
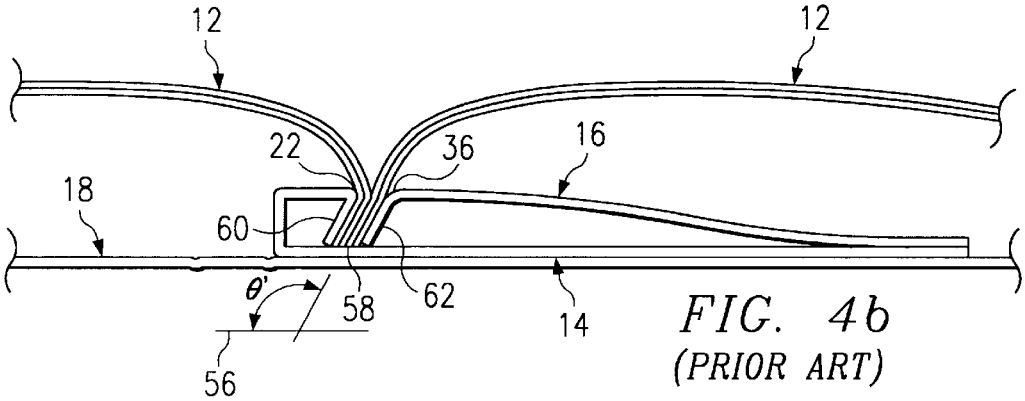
FIG. 4b (PRIOR ART)

As can be seen in FIG. 4*a*, when the report cover 10 is initially placed on a desk top and the cover opened, the portion 58 of the report 12 secured between the front panel 14 and rear panel 16 lies along an angle θ relative to the desk top, represented by line 56. Portion 60 of the front panel 14 between the first edge 20 and first hinge 22 and the portion 62 of the rear panel 16 between the first edge 34 and first hinge 36 also lie parallel to the portion 58 of the report 12 because of the staples 50. As one or more pages of the report 12 are opened, as shown in FIG. 4*b*, the portions 58, 60 and 62 each pivot about the first hinges 22 and 36 to angle θ' relative to the remainder of the report cover and desk. The angle θ' is determined in part by the number of pages of the report 12 on either side of the portion 58. As the user opens the report 12 to the back page of the report, as seen in FIG. 4*c*, the portions 58, 60 and 62 pivot further about the first hinges 22 and 36 to an angle θ".

Figure 4C:
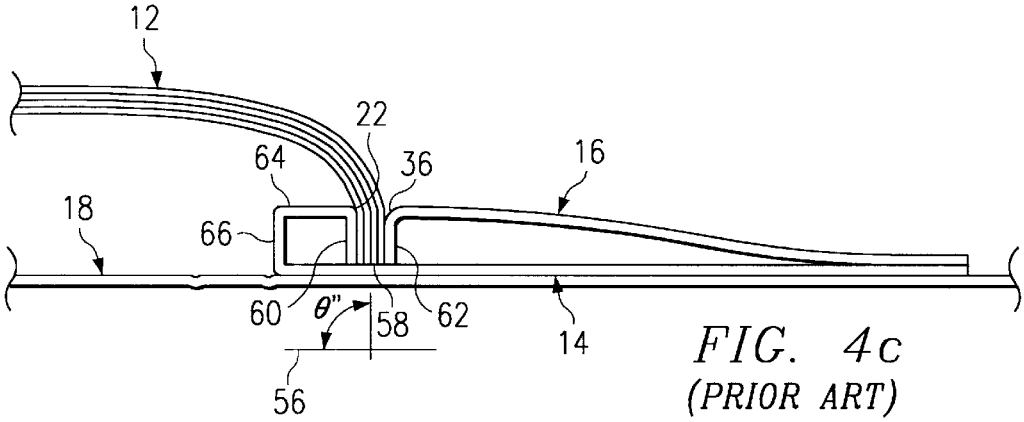
FIG. 4c (PRIOR ART)

The adhesive strip 38, securing front panel 14 to back panel 16, is spaced a sufficient distance from hinge 36 to permit the portion of back panel 16 between hinge 36 and adhesive strip 38 to separate from front panel 14 as seen in FIGS. 4*a–c* to permit the hinging action about hinges 22 and 36. Generally, the panel module 54 defines a right triangle when viewed from the end, as in FIGS. 4*a–c*. The hypotenuse is formed by portion 64 of front panel 14 between hinges 22 and 24, and the portion of rear panel 16 between hinge 36 and adhesive strip 38. Portion 66 of front panel 16 between hinges 24 and 26 forms one side. The portion of front panel 16 between hinge 26 and adhesive strip 38 forms the final side of the triangle. The portions 58, 60 and 62 are pivoted at hinges 22 and 36 lying generally along the hypotenuse.

As each page of the report is opened, the pivoting action about the first hinges 22 and 36 prevents any force from developing which would cause the report 12 to close in part or in whole from the page selected by the user. This provides a great advantage in eliminating any need for an external force, such as a paperweight, to hold the pages open and eliminates the need for creasing the pages, a technique frequently employed in prior art covers to resist the closing of the report because of the particular design of the report cover.

In the preferred design, the distance d is less than the distance a. This permits the hinging action about the first hinges 22 and 36 to occur with less resistance against the portion of the front panel 14 against which the portions 58, 60 and 62 abut. It is also preferred to make the distance c larger than either distance a or d to resist contact between portions 58, 60 and 62 and the inner portion of front panel 14. The distance b should be selected to permit the freedom of motion from the angle θ to angle θ" as illustrated in FIGS. 4*a* and 4*c*.

The report cover 10 also provides other significant advantages. Because the report 12 is only secured to the front panel 14 and rear panel 16 by staples, the report cover 10 can be readily disassembled and reassembled to insert or remove pages from the report 12. The typical paper report can be stapled along portion 58 numerous times before the report becomes worn or destroyed. The front panel 14 also acts to hide the staples 50 or other fastening structure which provides a more pleasing appearance to the report cover 10. The use of staples 50 to fasten the report 12 to the panels 14 and 16 also eliminates the need for costly devices to perform the rigidly accurate alignment of the report as needed in the prior art devices requiring a series of precisely aligned holes or slots for accepting pins or flexible rings as described previously. Portion 64 also acts as a convenient accent strip and can be embossed with any information desired.

In one report cover constructed in accordance with the teachings of the present invention, the distances employed are as follows: a=5/16 inch, b=3/8 inch, c=1/4 inch, d=5/16 inch, and e=5/16 inch. This report cover was used to hold a report printed on 8½ inch by 11 inch paper.

The panel module 54 can be fastened to any edge of the report 12 desired. For example, it would be more advantageous to fasten tax reports along the top edge of the tax reports. The module 54 would then be fastened along the upper portion of the inner rear cover portion 44 of cover 18. The tax report pages could then be opened by flipping the pages upwardly.

Figure 5:
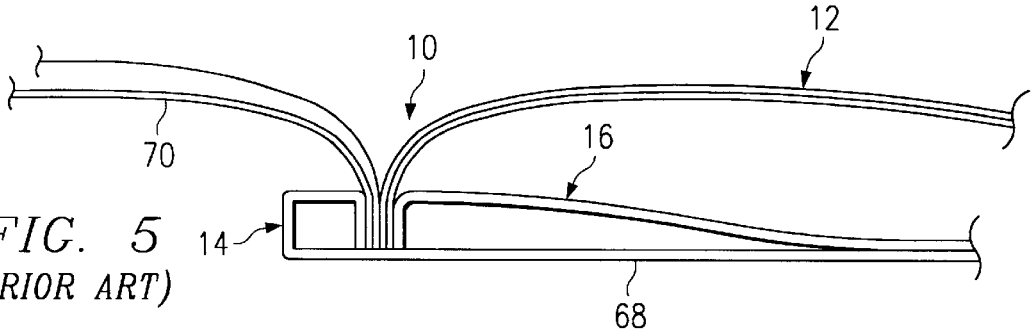
FIG. 5 (PRIOR ART)
FIG. 5 illustrates a report cover forming a modification of the report cover illustrated in FIGS. 1–4.

A first modification of the report cover 10 is illustrated in FIG. 5. Many similar elements are used in the modification shown in FIG. 5 and are indicated by identical reference numerals to the features noted previously. However, the modification illustrated in FIG. 5 does not require a cover 18 having front and rear cover portions 40 and 44 and an end portion 42. The front panel 14 has an extended portion 68 on the side of the third hinge 26 opposite the first edge 20 which forms the rear cover of the report cover 10. It is therefore unnecessary to provide the modification with adhesive strips 28 and 30. A single front cover 70 is used with the modification shown in FIG. 5 and is fastened between the portions 58 and 60 of the front panel 14 and report 12 as shown in FIG. 5.

Figure 6:
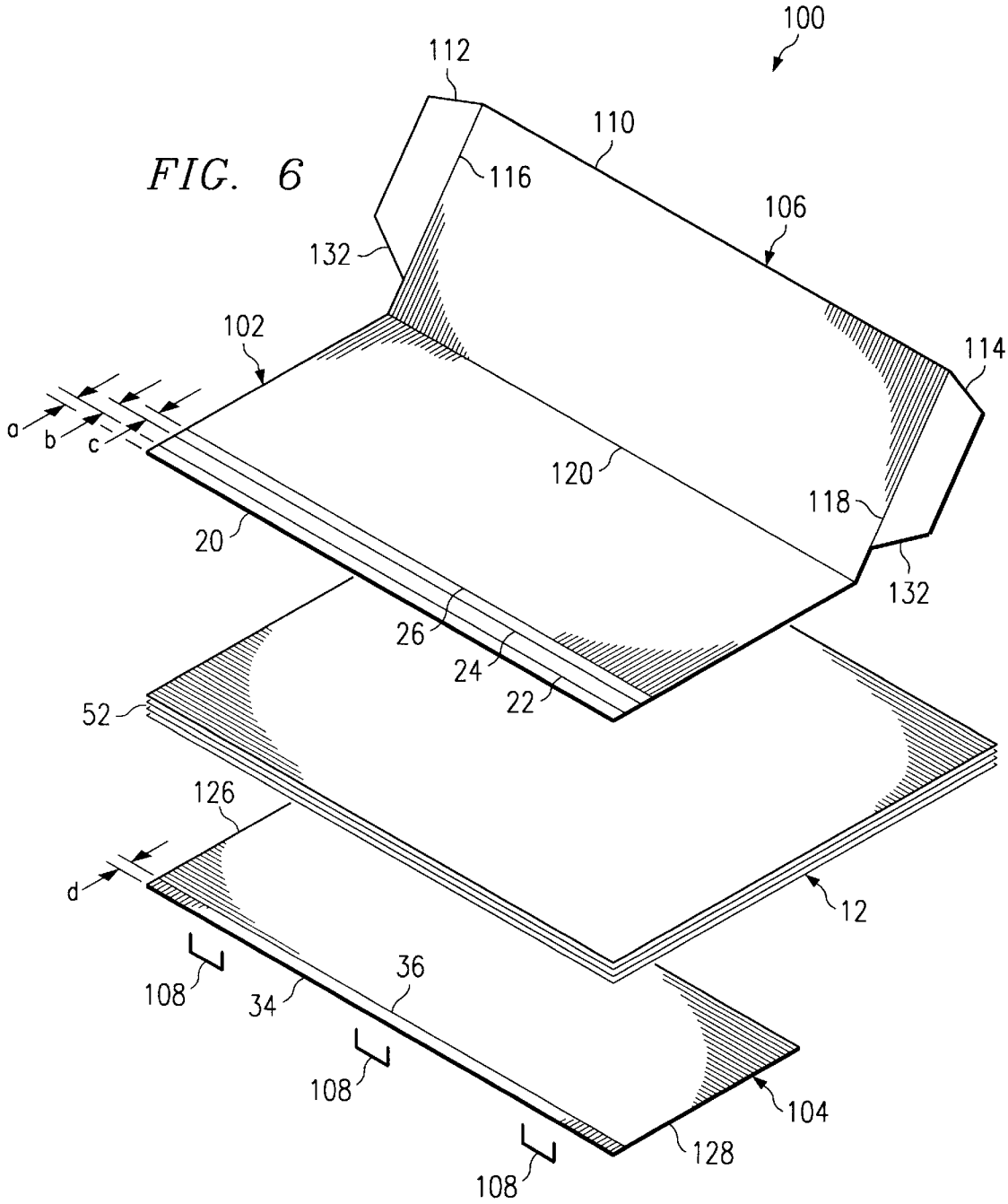
FIG. 6 is a perspective view of a report cover forming a second embodiment of the present invention.

With reference now to FIGS. 6–9*d*, a second embodiment of the present invention forming a report cover 100 will be described. As seen in FIG. 6, the report cover 100 includes a front panel 102 and a rear panel 104. Many elements of the front panel 102 are the same as in front panel 14, and are identified by the same reference numerals. However, front panel 102 includes a pocket portion 106 which will be described in greater detail hereinafter. Rear panel 104 is identical to rear panel 16, with the exception that rear panel 104 does not require the use of an adhesive strip 38. However, an adhesive strip 38 can be used on rear panel 104 in the identical position as used on rear panel 16 as discussed hereinafter.

As with report cover 10, the report 12 is secured between front panel 102 and rear panel 104 by staples 108 or other fastening mechanism, such as rivets, threaded members, deformable metal fasteners and the like.

Figure 7:
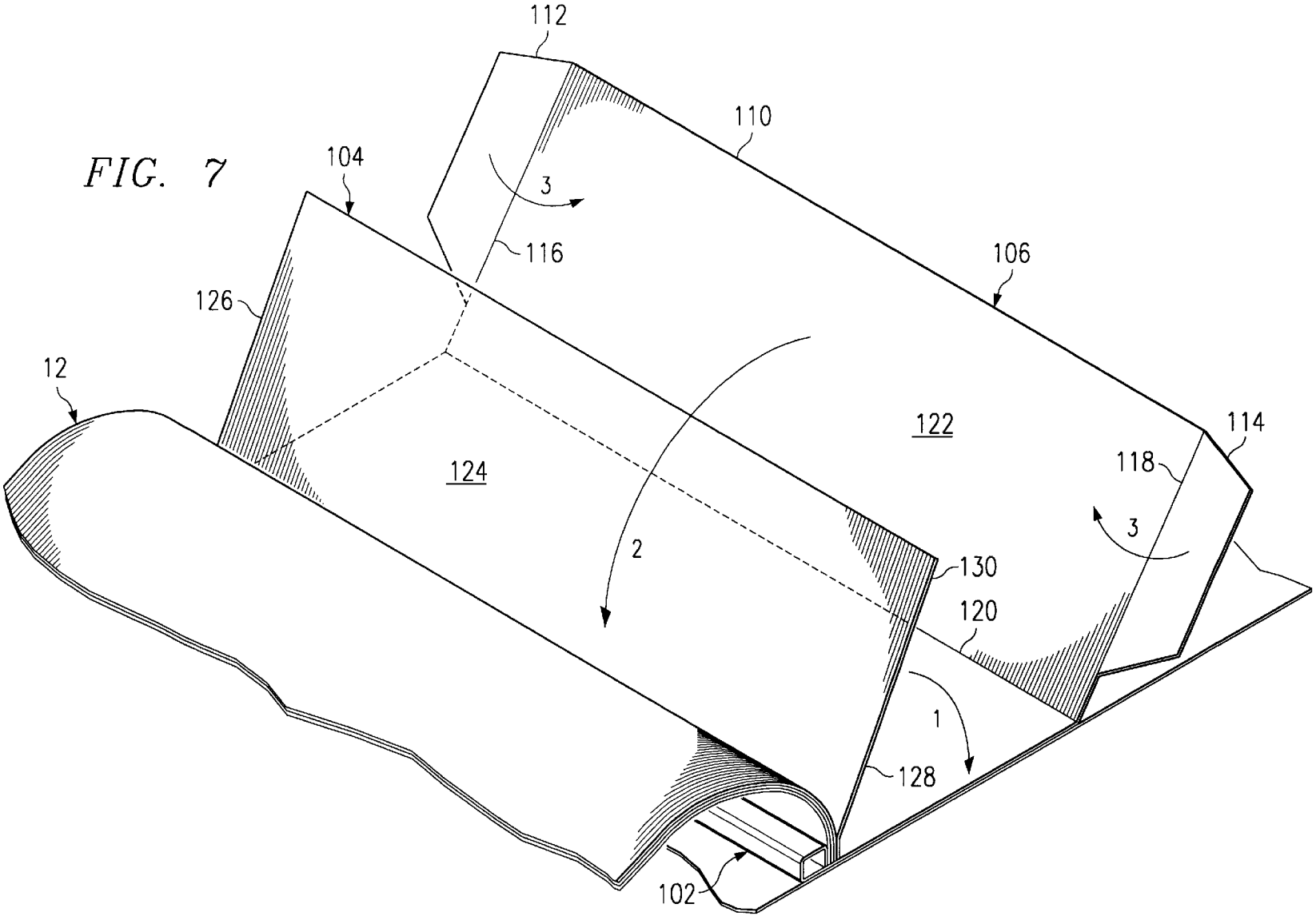
FIG. 7 is a perspective view illustrating the assembly of the report cover of FIG. 6.
Figure 8:
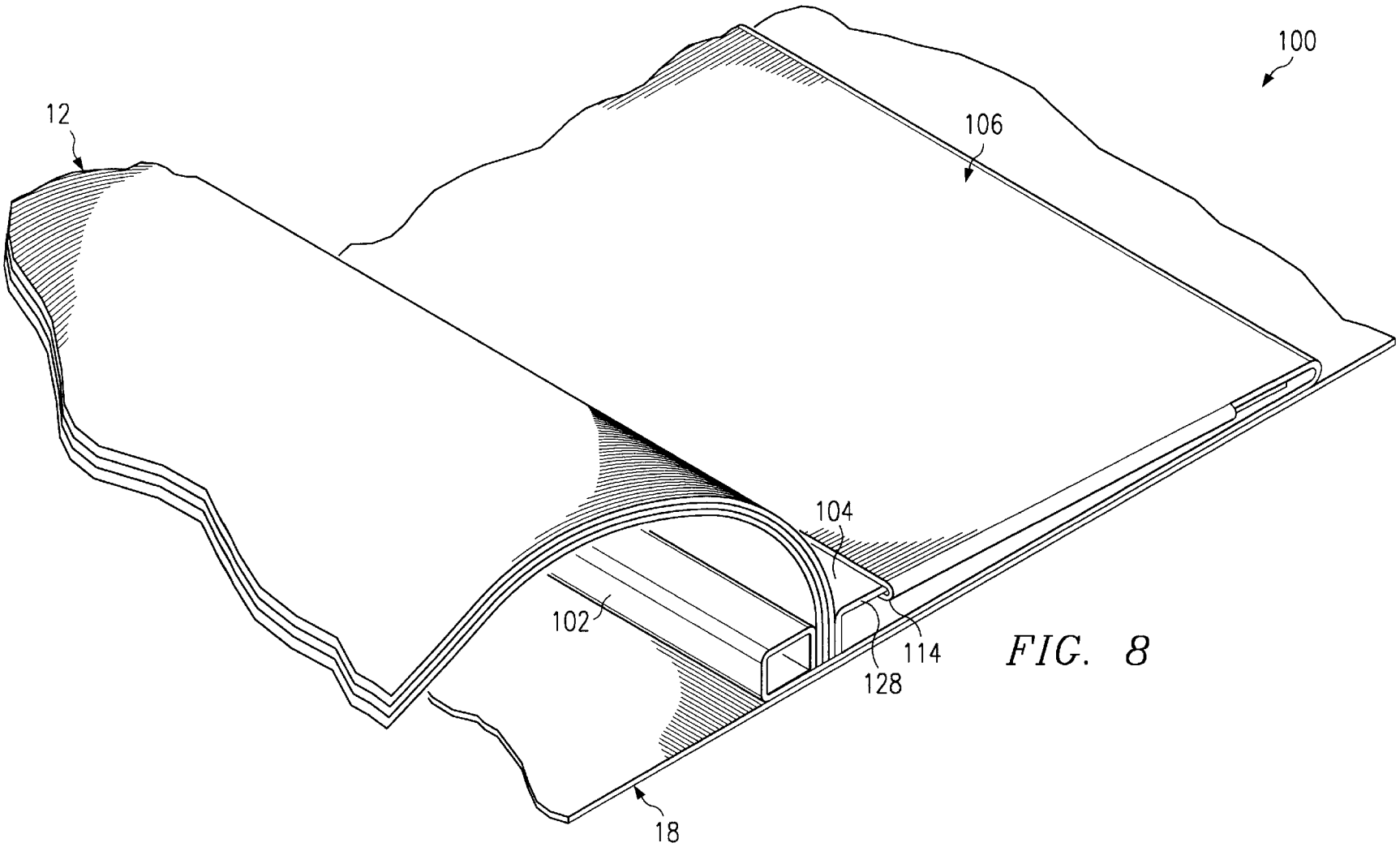
FIG. 8 is a perspective view of the report cover of FIG. 6 after assembly.

As with report cover 10, when the report 12 is fastened between the front panel 102 and the rear panel 104, the front panel 102 is folded about hinges 22, 24 and 26, as shown in FIG. 7. Front panel 102 preferably includes adhesive strips 28 and 30 to secure the front panel 102 on the cover 18, in a manner substantially the same as front panel 14. Alternatively, the modification of FIG. 5 can be used with front panel 102 with an extended portion 68 and using a single front cover 70.

However, in distinction to report cover 10, the rear panel 104 is not otherwise rigidly secured to the front panel 102 other than by the staples 108 or other suitable fasteners. Instead, the rear panel 104 is captured in the pocket portion 106 as will be described.

The pocket portion 106 preferably forms a part of the front panel 102 and includes a pocket panel 110 and side flaps 112 and 114. A hinge line 116 is formed between the side flap 112 and the pocket panel 110 and a hinge line 118 is formed between the side flap 114 and the pocket panel 110. The pocket panel 110 is itself connected to the rest of the front panel 102 through a hinge line 120. As illustrated in FIGS. 7, 8 and 9*a*–*d*, the pocket panel 110 is folded along hinge line 120 relative to the remainder of the front panel 102 and the side flaps 112 and 114 are folded about hinge lines 116 and 118 toward the inner side 122 of the pocket panel 110 when the outer side 124 of the rear panel 104 abuts the inner side 122 of the pocket panel 110, as seen in FIGS. 8 and 9*a*–*d* so that the side flaps 112 and 114 are folded about the edges 126 and 128 of the rear panel 104 and engage the inner side 130 of the rear panel 104.

As best seen in FIGS. 8 and 9*a*–9*d*, the pocket portion 106 captures the rear panel 104 to form a complete report cover operating in a similar manner to report cover 10. However, rather than the rear panel being directly secured to the front panel by an adhesive strip 38, the rear panel 104 is captured within the pocket formed by the pocket portion 106 and is slidable therein within a limited range of motion, as illustrated in FIGS. 9*a*–*d*, but is sufficiently captured so that it will not be released from the pocket formed by the pocket portion 106 unless the report cover is intentionally disassembled by forcing the side flaps 112 and 114 out of engagement with the rear panel, back to the configuration illustrated in FIG. 7, which releases the rear panel and allows access to the fasteners fastening the report 12 to the report cover 100. This makes it more easy to disassemble the report cover 100 if a copy of the report 12 is to be made or pages are to be added to or removed from the report 12. While staples 108 need merely be removed to separate the report 12 from the report cover 100, more readily removable fastening structure can be used as a substitute for staples 108, such as brads, bolts, rivets, screws, clips, eyelets, push pins, Duo Tang fasteners, Velobind fasteners and suitable metal, or plastic fasteners or binders and the like would facilitate the removal of the report 12 and the reassembly of the report 12 within the report cover 100.

As mentioned previously, adhesive strip 38 could be used on rear panel 104. For example, it may be desireable to use the feature of pocket portion 106 to allow documents in the report 12 to be removed, inserted or copied easily until the report is finished, then activate adhesive strip 38 to secure the rear panel 104 to front panel 102 just as in report cover 10 to make it more difficult to subsequently alter the report by disassembly of the report cover 100. Once the adhesive strip 38 is activated to secure rear panel 104 to front panel 102, the rear panel 104 can no longer move relative the pocket portion 106 as described above. Adhesive strip 38 can also be retained in report cover 100 to give the user the choice between binding the report 12 using pocket portion 106 to allow the report to be removed more easily from report cover 100, or use and activate the adhesive strip 38 to make it difficult to remove the report. A Velcro fastener, using mating hooks and loops could substitute for adhesive strip 38 if desired, allowing the report to be more easily disassembled.

Figure 9A:
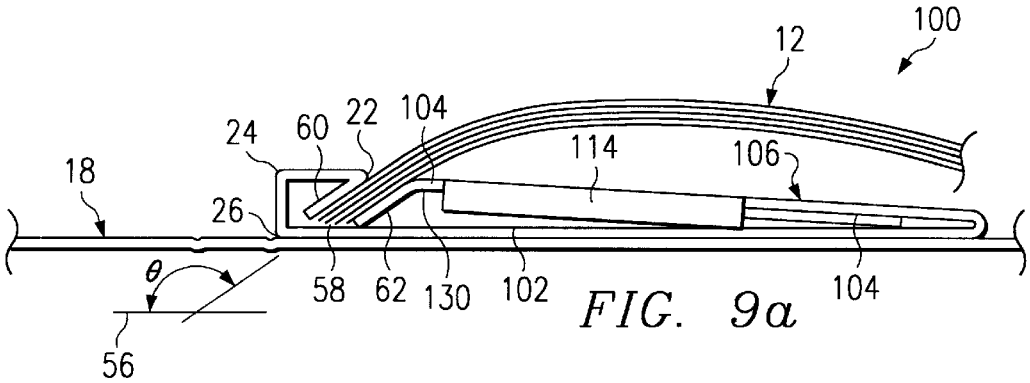
FIGS. 9*a–d* illustrate the pivoting action of the hinges in the front and back panels and the sliding of the back panel within the pocket portion which permits the report to be open to any page without the cover exerting a force to cause flyback of pages or close the report.
Figure 9B:
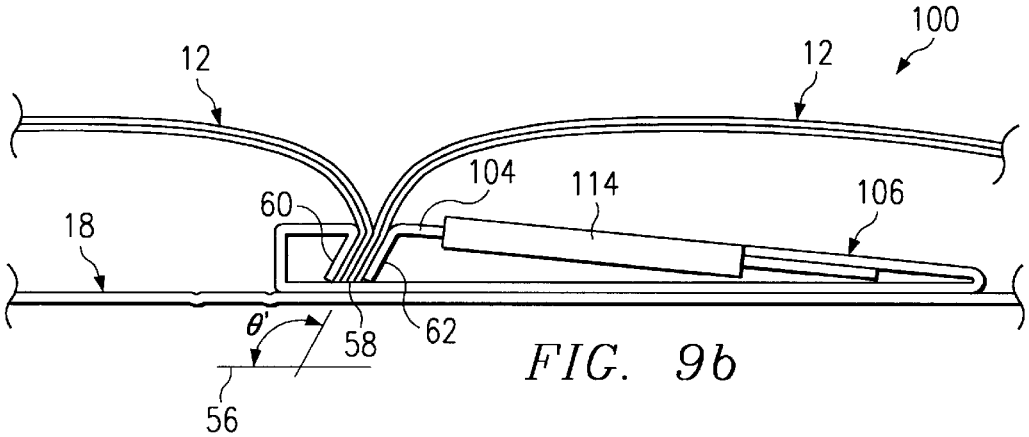
Figure 9C:
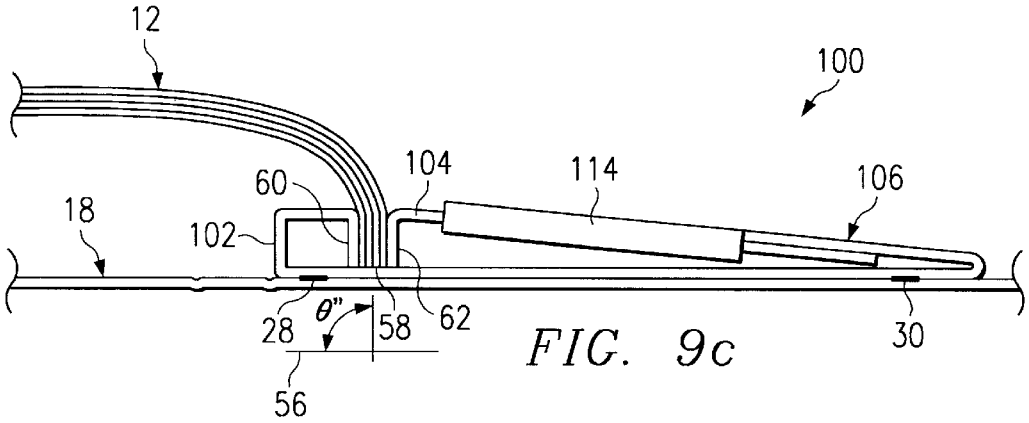
Figure 9D:
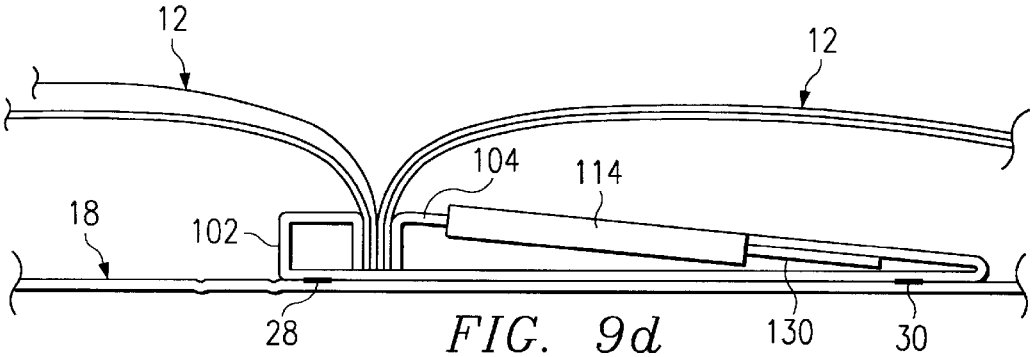

Just as in report cover 10, when report cover 100 is initially placed on a desktop and the cover opened, as seen in FIG. 9*a*, the portion 58 of the report 12 secured between the front panel 102 and the rear panel 104 lies along an angle θ relative to the desktop, represented by line 56. Portion 60 of the front panel 102 between the first edge 20 and first hinge 22 and the portion 62 of the rear panel 104 between the first edge 34 and first hinge 36 also lie in parallel planes to the portion 58 of the report 12 because of the staples 108 or other fasteners. As one or more pages of the report 12 are open, as shown in FIG. 9*b*, the portions 58, 60 and 62 each pivot about the first hinges 22 and 36 to angle θ' relative to the remainder of the report cover and desk. The angle θ' is determined in part by the number of pages of the report 12 on either side of the portion 58. As the user opens the report 12 to the back page of the report, as seen in FIG. 9*c*, the portions 58, 60 and 62 pivot further about the first hinges 22 and 36 to an angle θ". As can be seen, the rear panel 104 can slide within the pocket portion 106 in a direction generally parallel to the line 56 as the report pages are opened to accommodate the hinging action about the first hinges 22 and 36. However, because the side flaps 112 and 114 are captured between the rear panel 104 and the front panel 102, the rear panel 104 cannot separate from the pocket unless a specific effort to do so is made by forcing the side flaps 112 and 114 out of engagement with the rear panel 104 to the position shown in FIG. 6.

It will be noted that the side flaps 112 and 114 have tapered edges 132 to permit easier folding of the side flaps 112 and 114 about the rear panel 104. Alternatively, other designs of side flaps can be used, such as rounded tabs, etc.

While the pocket portion 106 is seen to form part of the front panel 102, it can be separate from the panel 102 if desired. If separate, the pocket portion 106 would include the pocket panel 110 and side flaps 112 and 114. The pocket portion 106 could be fastened to either the front panel 102 or the cover 18 by a flexible hinged connection, such as adhesive tape or the like, which would allow the pocket portion 106 to pivot about a line corresponding to the hinge line 120 previously described. It would also be possible to construct a cover 18 with integral side flaps 112 and 114. Also, a conventional report cover 10 can be modified by adding a pocket portion if desired, to achieve the advantages of the report cover 100. For example, a pocket portion 106 with pocket panel 110 and side flaps 112, 114, could be attached to front panel 14, or cover 18 in report cover 10 with a hinged connection, such as a strip of tape.

Although several embodiments of the present invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the scope and spirit of the invention.

What is claimed is:

1. A report cover for holding a report, comprising:

a front panel having a first edge at least three parallel hinges proximate the first edge;

a back panel;

the report being fastened to the front and back panels with first fastening means between the front and back panels along one edge of the report, the fastening of the front panel being between the first edge of the front panel and the closest hinge to said first edge;

the front panel being folded about said at least three parallel hinges to cover the edge of the report and hold the report; and a pocket portion capturing the back panel, with the portion of the front panel between the first edge and first hinge thereof pivoting about the first hinge to remain parallel to the report where fastened thereto as the report is opened to resist forces acting to close the report.

2. The report cover of claim 1 wherein the report can be readily removed from the report cover by disengaging the pocket portion from the back panel.

3. A method of forming a report cover comprising the steps of:

securing a report between first edges of front and rear panels along one edge of the report;

forming at least parallel hinges in the front panel generally parallel to and proximate the front edge of the front panel;

folding the front panel about the hinges to cover the edge of the report;

capturing the back panel within a pocket portion to permit pivotal motion about selected ones of said hinges to facilitate use of the report.

* * * * *